US008918957B2

(12) United States Patent
Lindquist et al.

(10) Patent No.: US 8,918,957 B2
(45) Date of Patent: Dec. 30, 2014

(54) VACUUM CLEANER NOZZLE

(75) Inventors: Tommy Lindquist, Farsta (SE); Bo Pilsmo, Arsta (SE)

(73) Assignee: AB Electrolux (SE)

( * ) Notice: Subject to any disclaimer, the term of this patent is extended or adjusted under 35 U.S.C. 154(b) by 644 days.

(21) Appl. No.: 13/202,519

(22) PCT Filed: Feb. 15, 2010

(86) PCT No.: PCT/SE2010/000036

§ 371 (c)(1),
(2), (4) Date: Dec. 21, 2011

(87) PCT Pub. No.: WO2010/095995

PCT Pub. Date: Aug. 26, 2010

(65) Prior Publication Data

US 2012/0090132 A1 Apr. 19, 2012

Related U.S. Application Data

(60) Provisional application No. 61/155,023, filed on Feb. 24, 2009.

(30) Foreign Application Priority Data

Feb. 20, 2009 (SE) ..... 0900224

(51) Int. Cl.
*A47L 9/02* (2006.01)
*A47L 9/24* (2006.01)

(52) U.S. Cl.
CPC .... *A47L 9/02* (2013.01); *A47L 9/24* (2013.01)
USPC ..... 15/415.1

(58) Field of Classification Search
USPC ..... 15/415.1, 421, 364, 367, 373, 398, 329
See application file for complete search history.

(56) References Cited

U.S. PATENT DOCUMENTS 4,573,237 A 3/1986 Kochte et al.
4,621,390 A 11/1986 Hamton et al.
(Continued)

FOREIGN PATENT DOCUMENTS

| | | |
|---|---|---|
| EP | 1 110 496 | 6/2001 |
| SE | 436 394 | 12/1984 |
| WO | WO 2005/074778 | 8/2005 |

OTHER PUBLICATIONS

Office Action for U.S. Appl. No. 11/733,683 dated Sep. 18, 2009.

(Continued)

*Primary Examiner* — Robert Scruggs
(74) *Attorney, Agent, or Firm* — RatnerPrestia

(57) ABSTRACT

The present invention provides, in one embodiment, a vacuum cleaner nozzle comprising a nozzle body (1); a suction plate (2) having an elongated suction inlet (3), wherein the suction plate (2) is pivotally connected to the nozzle body (1) about a first pivot axis (A), which first pivot axis (A) extends parallel to the elongated direction of the suction inlet (3); a nozzle outlet device (5) having, at a first end thereof, a tubular opening (6), which tubular opening is matable with a tubular component (7) of a vacuum cleaner; and flexible hose (8) which is arranged to interconnect the suction plate (2) with the nozzle outlet device (5) such that the suction inlet (3) is in fluid communication with the tubular opening (6) of the nozzle outlet device (5). The nozzle outlet device (5) is connected to the nozzle body (1) by means of a link element (9) comprising a forked first end and a second end, wherein the flexible hose (8) extends within the forked first end of the link element (9), the forked first end (10) of the link element (9) is pivotally connected to the nozzle body (1) on either side of the flexible hose (8) about a second pivot axis (B), which second pivot axis (B) is parallel with the first pivot axis (A), and the second end (11) of the link element (9) is connected to a second end of the nozzle outlet device (4) about a third pivot axis (C), which third pivot axis (C) is perpendicular to the first and second pivot axes (A, B) and to an axis (D) passing through the first and second ends of the link element (9).

13 Claims, 4 Drawing Sheets

(56) References Cited

U.S. PATENT DOCUMENTS

| | | | |
|---|---|---|---|
| 5,524,321 | A | 6/1996 | Weaver et al. |
| 5,584,095 | A | 12/1996 | Redding et al. |
| 6,839,934 | B2 | 1/2005 | Houghton et al. |
| D565,814 | S | 4/2008 | Ågren et al. |
| D582,111 | S | 12/2008 | Ågren et al. |
| 7,882,593 | B2 | 2/2011 | Beskow et al. |
| 7,979,952 | B2 | 7/2011 | Beskow et al. |
| 8,151,411 | B2 | 4/2012 | Beskow et al. |
| 8,225,456 | B2 | 7/2012 | Håkan et al. |
| 8,302,251 | B2 | 11/2012 | Beskow et al. |
| 8,402,600 | B2 | 3/2013 | Beskow et al. |
| 2004/0216263 | A1 | 11/2004 | Best et al. |
| 2005/0055798 | A1 * | 3/2005 | Bagwell et al. ..... 15/415.1 |
| 2008/0040883 | A1 | 2/2008 | Beskow et al. |

OTHER PUBLICATIONS

Reply to the Office Action of Office Action for U.S. Appl. No. 11/733,683 dated Sep. 18, 2009.

Office Action for U.S. Appl. No. 11/733,683 dated Mar. 10, 2010.

Photographs of Electrolux "Ergo Rapido" product on sale in the United States prior to Feb. 20, 2009.

* cited by examiner

VACUUM CLEANER NOZZLE

This application is a U.S. National Phase application of PCT International Application No. PCT/SE2010/000036, filed Feb. 15, 2010 and claims priority to Swedish Patent Application No. 0900224-7 filed Feb. 20, 2009 and the benefit of U.S. Provisional Application No. 61/155,023 filed Feb. 24, 2009.

TECHNICAL FIELD OF THE INVENTION

The present invention relates to a vacuum cleaner nozzle comprising a nozzle body having a nozzle body, a suction plate including a suction inlet, and a nozzle outlet. The nozzle further includes a flexible hose and a linking arrangement.

TECHNICAL BACKGROUND

Generally, within the field of vacuum cleaning, a vacuum cleaner is usually provided with a vacuum cleaner nozzle, utilized for removing objects like dust, particles, fibres, hair, etc. from various hard and soft surfaces, such as marble, parquet, rugs and carpets. The nozzle, including a suction inlet, is normally connected to a tube for forwarding the objects by means of an air stream to a dust bag in the body of the vacuum cleaner. Furthermore, the tube is also used for controlling the motion and moving scheme of the nozzle.

A vacuum cleaner nozzle enabling an improved cleaning process is disclosed in WO 05/074778, in which a suction plate is in fluid communication with a nozzle outlet via a flexible hose and a tube support. The tube support, connecting the flexible hose with a bent tube member serving as the nozzle outlet, is provided with a sleeve. The sleeve can be turned about a horizontal wheel shaft transverse to the direction of intended movement of the nozzle, whereas the bent tube member connecting the sleeve can be turned about a direction parallel to the intended movement of the nozzle.

This known prior art nozzle functions well in many situations. However, it is desired to further improve the ability of the nozzle to clean specifically in small or complex spaces which require specific moving schemes of the nozzle.

SUMMARY OF THE INVENTION

It is an object of the present invention to provide a vacuum cleaner nozzle that provides an improved cleaning regarding the aspects of an augmented versatility at operation and improved ergonomic conditions for the user as compared to the prior art nozzle mentioned above.

This and other objects may be achieved according to embodiments of the present invention. Non-limiting examples of the invention are described in the specification, claims and figures.

According to one exemplary embodiment of the invention, the vacuum cleaner nozzle comprises a nozzle body, a suction plate including a suction inlet, a nozzle outlet device, and a flexible hose and link element which interconnects the nozzle outlet device with the suction plate and nozzle body, respectively. Thus, the suction plate has an elongated suction inlet, wherein the suction plate is pivotally connected to the nozzle body about a first pivot axis. This first pivot axis extends parallel to the elongated direction of the suction inlet, i.e. in the direction in which the elongated suction inlet elongates. Moreover, the vacuum cleaner nozzle comprises a nozzle outlet device which has, at a first end thereof, a tubular opening. This tubular opening is matable with a tubular component of a vacuum cleaner. The tubular component may, for example, be a tube, hose or the like. Alternatively, the tube or hose may also be provided with a handle, or the tube per se may be formed or shaped as a handle means, e.g. as a bent tube. Thus, the vacuum cleaner includes a motor for providing a flow of suction, a suction bag for collecting the dust, and a tube that is in fluid connection with the bag, for reaching and accessing the place to be cleaned. Furthermore, the vacuum cleaner nozzle comprises a flexible hose which is arranged to interconnect the suction plate with the nozzle outlet device. Thereby, the suction inlet is in fluid communication with the tubular opening of the nozzle outlet device. The nozzle outlet device is connected to the nozzle body by means of a link element. This link element comprises a forked first end and a second end. The flexible hose extends within the forked first end of the link element. Moreover, the forked first end of the link element is pivotally connected to the nozzle body on either side of the flexible hose about a second pivot axis. This second pivot axis is parallel with the first pivot axis. The second end of the link element is connected to a second end of the nozzle outlet device about a third pivot axis. Moreover, this third pivot axis is perpendicular to the first and second pivot axes and to an axis passing through the first and second ends of the link element. In other words, the third pivot axis which is perpendicular to the longitudinal direction of the link element, i.e., the axis passing through the first and second ends of the link element is pivotally arranged about the second pivot axis. Thus, the link element provides a linking arrangement having a double-pivotal connection, wherein the two pivot axes of the double-pivotal connection remain perpendicular to each other during the movement of the linking arrangement.

Thus, a vacuum cleaner nozzle having a pivotal suction inlet may be improved by using a linking arrangement according to the exemplary embodiment, resulting in a nozzle having a combination of a low height and a good maneuverability. Thereby, a versatile vacuum cleaner nozzle with improved cleaning properties is achieved.

The nozzle is, during a conventional cleaning process or operation, moved on a surface which is also herein referred to as a "surface being cleaned" or a "cleaning surface". Moreover, the term "height" is defined as the height of the nozzle in its cleaning position on the surface to be cleaned relative to the surface, i.e. the height is the distance measured from the surface to the top of the nozzle. Thus, a nozzle having a low height has a low overall height relative the surface being cleaned, conventionally the floor. It is to be noted that the term "low height" is herein also referred to as "low overall height" or "low profile".

An advantage with the invention may be that the link element ensures an improved adaptability for the cleaning procedure, as the element provides the user to more easily clean areas commonly more difficult to access such as corners, areas under tables and sofas, etc. The forked end of the link element allows a low pivotal connection of the link element to the nozzle body since the forked first end may connect the body on either side, i.e. lateral sides, of the flexible hose. Thus, the flexible hose extends within the forked first end of the link element, i.e. the hose extends in the space defined by the forked end. Furthermore, in combination with the forked first end, the second end of the link element with its pivotal connection with the nozzle outlet device provides a versatile movement scheme of the nozzle body, including the suction inlet, relative the nozzle outlet device. Consequently, by means of an external tubular component, such as tube or hose portion connected to the tubular opening of the nozzle outlet device, the suction inlet is easily controlled and maneuvered and may adopt a wide range of controllable positions.

The linking arrangement, i.e. the interaction of the link element and its pivotal axes with the nozzle body and nozzle outlet device, enables a low overall height. In other words, during cleaning, the nozzle has a low profile or has a low height measured from the surface being cleaned. Such a low overall height is advantageous since the nozzle may easily access narrow spaces, such as under sofas or other objects closely arranged to the surface being cleaned. Of course, even if the overall height is not minimized, the invention still may have improved functions or utility.

It should be noted that the term "an oval or rectangular cross-section" as used herein is intended to refer to an element having a cross-section that has a low height compared to the width, i.e. a flat, narrow-like or low-profiled element. In other words, the nozzle, standing on a surface to be cleaned, is low in height when measuring from the surface to the top of the nozzle.

It should be noted that the term "in fluid connection" as used herein is intended to refer to a connection between two objects which admits a fluid, such as air, or in this case, dust-laden air, to flow between these objects.

According to embodiments of the invention, the flexible hose may have a generally oval or rectangular cross-section. Such a hose contributes even further to a low overall height or nozzle profile, further enhancing the nozzle versatility when cleaning.

In one embodiment, the second end of the link element may have a plate-like shape, i.e. the second end has a flattened shape, which further reduces the height of the nozzle resulting in an even further versatile use of the vacuum cleaner nozzle.

According to embodiments of the vacuum cleaner nozzle, the nozzle outlet device may comprise, at the second end thereof, a generally oval or rectangular opening connected to the flexible hose, and wherein the generally oval or rectangular opening is in fluid connection with the tubular opening at the first end by means of a transformation conduit. Thus, the generally oval or rectangular opening is in fluid connection with the tubular opening. Moreover, a transformation conduit transforms the cross-section at the second end (generally oval or rectangular) into the cross-section of the first end (tubular) such that the suctioned dust-laden air emanating from the flexible hose may continue into the external tube, which is connected to the tubular end of the nozzle outlet device, and finally into an dust collecting bag or dust bag. An advantage of the generally oval or rectangular opening at the second end of the nozzle outlet device is that a hermetic connection, if combined with a seal or the like, may be achieved with the thereto connected flexible hose, due to their similar cross-sections. As a result, the suction properties, and thereby the cleaning properties, may be enhanced, since air leakage is avoided or at least significantly reduced.

In another embodiment of the invention, the transformation conduit is generally straight, whereby a generally straight flow path through the nozzle outlet device from the generally oval or rectangular opening to and through the tubular opening is achieved. Such straight, i.e. not bent, construction allows the dust-laden air to flow in a straightforward flow path without any bends or curves, which improves the suction properties, and thereby the cleaning properties, even further.

In another embodiment of the invention, the nozzle outlet device comprises, at the second end thereof, a plate-like portion arranged to pivotally interact with the plate-like end of the second end of the link element, wherein the plate-like portion is arranged in parallel with the oval or rectangular opening such that the thickness of the two substantially corresponds to the outer diameter of the tubular opening. In other words, a plate-like portion of the nozzle outlet device, at the second end thereof, is pivotally connected to the plate-like end of the link element, at the second end thereof. Furthermore, the plate-like portion is also arranged in parallel with the oval or rectangular opening in such a way that the thickness of the two substantially corresponds to the outer diameter of the tubular opening. Thus, by arranging the nozzle outlet device in such a manner a controlled thickness is achieved which contributes even further to a low overall height.

In accordance with another exemplary embodiment, the link element, the flexible hose and the nozzle outlet device are arranged in such manner that the thickness substantially corresponds to the outer diameter of the tubular opening. Thus, when the tubular opening of the nozzle outlet device is positioned in parallel to the surface being cleaned, the vacuum cleaner nozzle may measure a very low height without limiting the control of the nozzle or restraining the movement scheme of the nozzle, i.e. without limiting the suction area.

In yet another embodiment, the suction plate is symmetrically arranged about the first pivot axis and wherein the elongated suction inlet is symmetrically arranged relative to the first pivot axis. The suction plate is symmetrically arranged to the first pivot axis such that the first pivot axis and a centerline of the elongated suction inlet in the elongated direction extend in a common plane which is perpendicular to the elongated suction inlet. In other words, a normal plane to the suction inlet, i.e. perpendicular to the suction inlet, connects the first pivot axis and the elongated centerline, i.e. along the elongated direction, of the suction inlet. Thereby, the same suction performance is achieved irrespectively of the pivot direction, i.e. clockwise or counter-clockwise, thereby improving the cleaning result.

According to another embodiment, the vacuum cleaner nozzle may comprise glide means for keeping a desired distance between the suction inlet and a surface being cleaned, in which the glide means are arranged within the suction inlet. The glide means, having a predetermined length/height, are preferably fixed to an inner surface of suction inlet, i.e. at a surface of the suction plate. An advantage of the glide means is that it distances the suction inlet, i.e. edge/surface portions of the suction plate, from the surface being cleaned thereby preventing the suction inlet from, due to the sucking force, clinging to the surface. A suction plate adhering to the cleaning surface may easily produce unwanted scratches or the like in the surface. Thus, the glide means are especially advantageous when vacuum cleaning hard, even surfaces. Consequently, such glide means provide a versatile movement scheme of the nozzle. The glide means may be symmetrically arranged within the suction inlet relative the first pivot axis so that the effect of the glide means is equal irrespective of pivot direction.

According to another embodiment, the glide means may be arranged such that when the elongated suction inlet is pivoted a desired angle about its axis, the glide means are elevated above the surface being cleaned. In other words, when the nozzle plate is pivoted the glide means are lifted above the surface being cleaned. This is especially the case when cleaning carpets or other soft surfaces. In such a case, the suction inlet adheres, due to the suction force, to the soft surface. Thereafter, when a forward or backward force is applied to the nozzle via the tubular opening portion of the nozzle outlet device and the thereto connected external tube, the suction inlet is forced to pivot. Thereby, the glide means are automatically, due to the pivotal motion, elevated or lifted relative the surface being cleaned.

At flat, even surfaces the glide means provides a distance to the surface being clean for avoiding accidental scratches or marks in the surface. On the other hand, when vacuum cleaning soft surfaces, such as carpets or the like, the suction plate sinks or penetrates into the soft surface, due to suction forces. Thus, the predetermined distance is difficult to maintain when cleaning a soft surface. However, when the suction plate which is adhered to the soft surface is forced to move back and forth, the suction plate pivots whereby the glide elements are automatically pulled up.

Another case is when a semi-soft surface is to be cleaned, when the glide element is not completely penetrated into the soft surface. In this case the glide means provides an advantageous distance, which is short but nevertheless a distance. The suction performance is thereby improved.

In one embodiment, the glide means may be wheels for supporting the nozzle. A smooth and low-frictional movement of the nozzle is thereby achieved. The wheels may be arranged in various ways regarding the choice of material, the radial size and the width. Also, the wheels' contact surface may be made of a rubber material, or similar frictional materials, such that a good grip with the surface being cleaned is achieved.

According to another embodiment, the vacuum cleaner nozzle comprises brush means, rubber strips and/or similar devices, that are attached to the nozzle body and are arranged at least partly around the elongated suction inlet. For example, a first brushing element may be arranged at a front side on the body relative to the suction inlet and second brushing element may be arranged on a back side relative the suction inlet. In other words, the first brushing element is arranged on a forward side of the nozzle body and the second brushing element on a backward side. The terms forward and backward are related to a forward and a backward direction or movement, respectively, of the nozzle. Furthermore, the first and second brushing elements may each be a brush, a rubber rake, strip or the like, or a felt strip made of felt cloth or the like. Alternatively, the first and second brushing elements may be different in shape and material, e.g. the first brushing element may be a brush and the second may be a rubber strip. Thereby, dust particles or objects may be collected and suctioned into the suction inlet. The brush means are especially advantageous when cleaning surfaces having slots therein (such as grout lines between tiles) or other cavities, or a when cleaning uneven surfaces. The dust particles or objects, which are often gathered within these areas or space, may easily be collected by the brush means and suctioned into the suction inlet. The brush means which surround the suction inlet may also create an increased underpressure relative to space outside the brush means, i.e. the space inside the brush means has a lower pressure relative to the space outside the brush means, thereby enhancing the vacuum cleaning performance to more easily collect dust particles or objects gathered within these areas or spaces. Furthermore, the brush means may also provide a polishing effect on hard surfaces and a combing effect on soft surfaces, such as carpets or the like. Alternatively, the brush means may also be retractable relative the surface being cleaned. The retractable feature is, for example, useful when transferring the nozzle from a hard surface to a soft surface, such as a carpet.

BRIEF DESCRIPTION OF THE DRAWINGS

Further details and aspects of the present invention will become apparent from the following detailed description with reference to the accompanying drawings, in which.

DETAILED DESCRIPTION OF THE DRAWINGS

Figure 1:
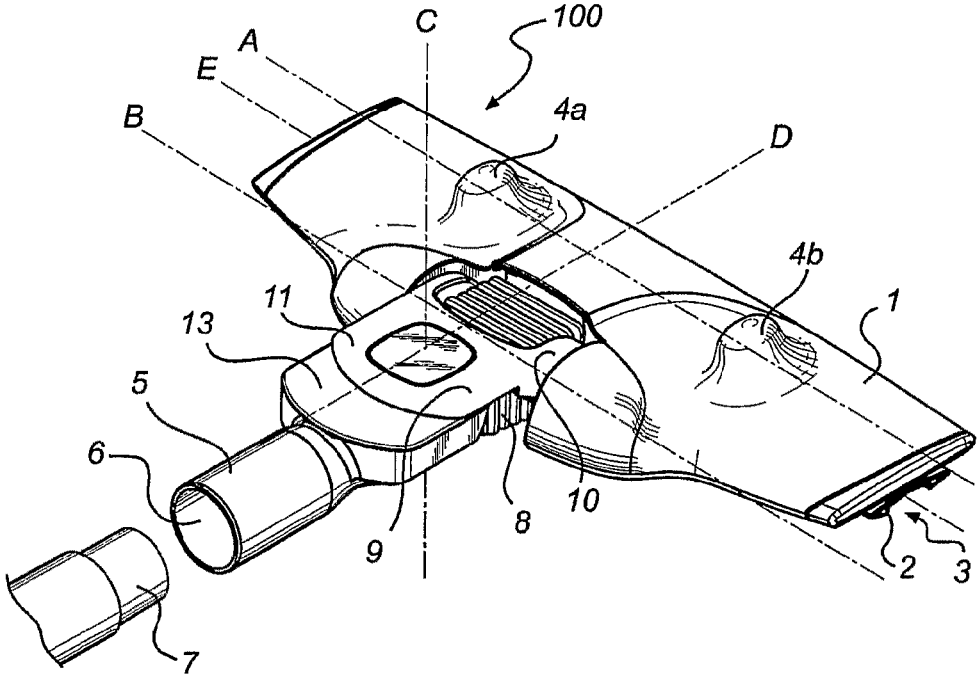
FIG. 1 is a perspective view of a vacuum cleaner nozzle according to one exemplary embodiment of the invention.

In FIG. 1, an exemplary embodiment of a vacuum cleaner nozzle 100 is provided with a rectangular-shaped nozzle body 1, comprising a suction plate 2 having an elongated suction inlet 3, wherein the suction plate 2 is connected to the nozzle body 1 about a first pivot axis A extending parallel to the elongated direction of the suction inlet 3. The pivotal connection of the suction plate 2 to the nozzle body 1 is arranged in housings 4*a* and 4*b* in the nozzle body 1, wherein the housings 4*a* and 4*b* are symmetrically provided along pivot axis A relative the center of the suction inlet. The nozzle 100 further comprises a nozzle outlet device 5 having, at a first end thereof, a tubular opening 6 matable with a tubular component 7 of a vacuum cleaner, which is shown as portion of a tube end. A flexible hose 8, constructed as a bellows with a generally oval or rectangular cross-section, is arranged to interconnect the suction plate 2 with the nozzle outlet device 5 such that the suction inlet 3 is in fluid communication with the tubular opening 6 of the nozzle outlet device 5. The nozzle outlet device 5 is connected to the nozzle body 1 by means of a link element 9 comprising a forked first end 10 and a plate-like second end 11 wherein the flexible hose 8 extends within the forked first end 10 of the link element 9. An opening 12 with a generally oval or rectangular cross-section is provided at the second end 11 of the nozzle outlet device 5, wherein the opening is in fluid connection with the tubular opening 6 by means of a transformation conduit. This conduit transforms the rectangular or oval cross-section, connected to the flexible hose 8 at the second end, into a tubular cross-section at the first end.

A plate-like portion 13, provided above the rectangular opening 12, is arranged to pivotally interact with the plate-like end 11 of the second end of the link element 9, wherein the plate-like portion 13 is arranged in parallel with the rectangular opening 12 such that the thickness of the two substantially corresponds to the outer diameter of the tubular opening 6 of the nozzle outlet device 5.

The forked first end 10 of the link element 9 is pivotally connected to the nozzle body 1 on either side 9*a* and 9*b* of the flexible hose 8 about a second pivot axis B parallel with the first pivot axis A. Although not shown, it is understood that the pivotal connection between the forked first end 10 and the nozzle body 1 enables a rotation of the link element about the first pivot axis A such that the link element may be positioned into at least an elongate upward position. Suitable pivot arrangements for this feature are known in the art, and include, for example, a simple trunnion-mount, a pin and bushing arrangement, bearings, and so on. The second end 11 of the link element 9 is connected to a second end of the nozzle outlet device 5 about the third pivot axis C. The pivotal connection between the second end 11 of the link element 9 and the portion 13 enables a rotation about the third pivot axis C, independent of the rotation about the first pivot axis, such that tubular opening 6, at least, may point in a direction parallel to the suction inlet. A centerline E, i.e. a line in the middle of the suction inlet 3 dividing the inlet into to symmetrical halves, of the elongated suction inlet 3 extends in the elongated direction.

Figure 2:
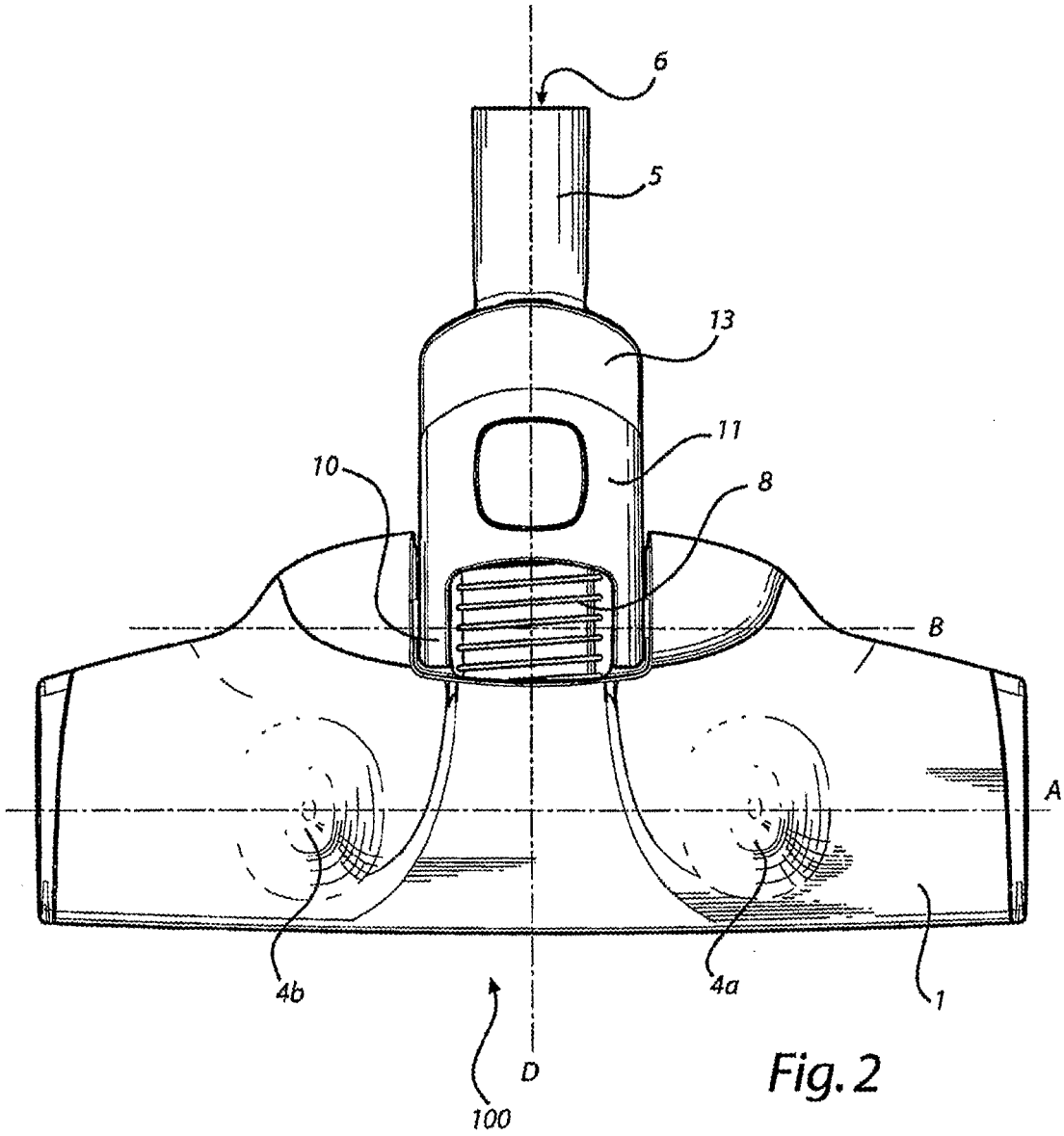
FIG. 2 is a top view of the vacuum cleaner nozzle of FIG. 1.

FIG. 2 is a top view of the vacuum cleaner nozzle 100. The first pivot axis A, extending through the housings 4*a* and 4*b* on the nozzle body 1, is parallel to axis B extending through the pivotal connections 9*a* and 9*b* of the forked first end 10 to the nozzle body 1. In FIG. 2, an axis D is perpendicular to axes A and B and C. Axis D is an axis which passes through the first and second ends of the link element 9, which in FIG. 2 passes through the center of the nozzle body 1, the flexible hose 8, the linking element 9 and the nozzle outlet 5.

Figure 3:
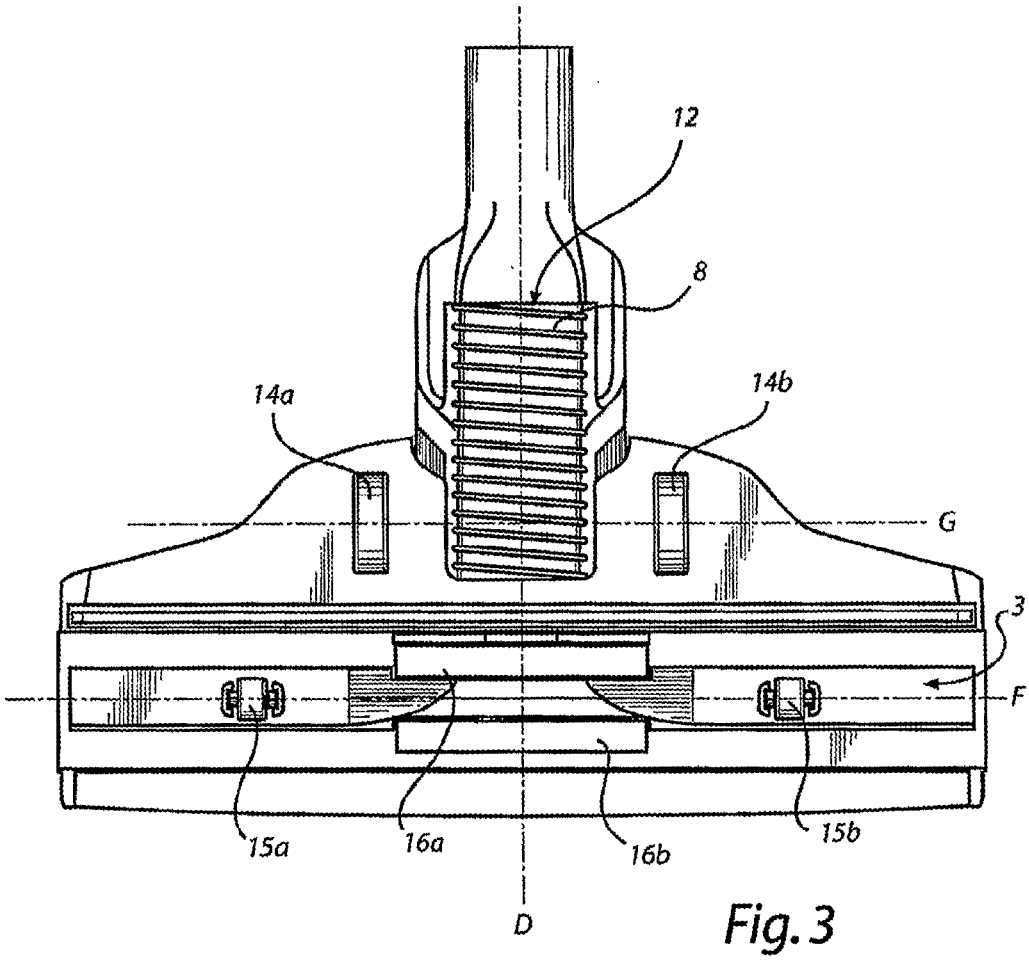
FIG. 3 is a bottom view of the vacuum cleaner nozzle of FIG. 1.

FIG. 3 is a bottom view of the vacuum cleaner nozzle 100. This figure shows a first pair of wheels 14*a* and 14*b*, wherein the wheels are symmetrically provided on either side of the flexible hose 8, along an axis G, which may be parallel to axis A and axis B. A second pair of wheels 15*a* and 15*b*, having diameters smaller than diameters of first pair of wheels 14*a* and 14*b*, is arranged within the elongated suction inlet 3 such that the wheels are symmetrically provided on either side of axis D, about a wheel axis F of the wheels which may be parallel to the centerline E. The axis F is parallel, to the axis G. A pair of rectangular-shaped brush portions 16*a* and 16*b* may be provided on the elongated suction inlet 3, the brush portions 16*a* and 16*b* being symmetrically provided on either side of the centerline E.

Figure 4:
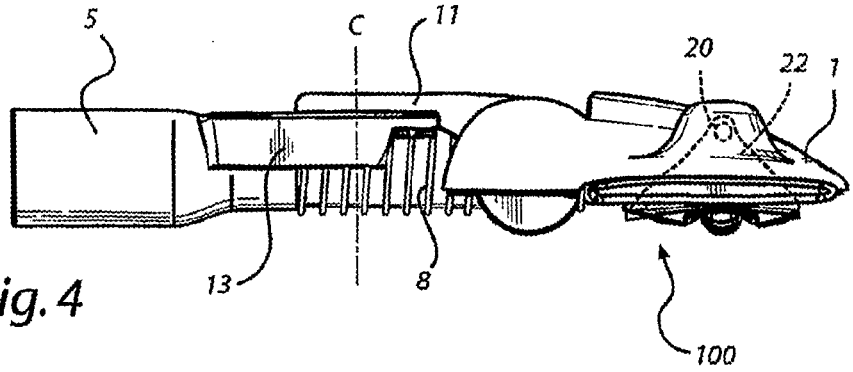
FIG. 4 is a side view of the vacuum cleaner nozzle of FIG. 1.

FIG. 4 is a side view of the vacuum cleaner nozzle 100 along the axis D. The pivotal connection between the forked first end 10 of the link element 9 and the nozzle body 1 is not rotated, such that the nozzle body 1, the flexible hose 8 and the nozzle outlet device 5 are aligned along axis D. As shown, the housings 4*a*, 4*b* include pivots 20 to which the suction plate 2 is pivotally attached via pivot arms 22. If used, this pivotal mounting allows the suction plate 2 to pivot forwards and backwards with respect to the nozzle body 1.

Figure 5:
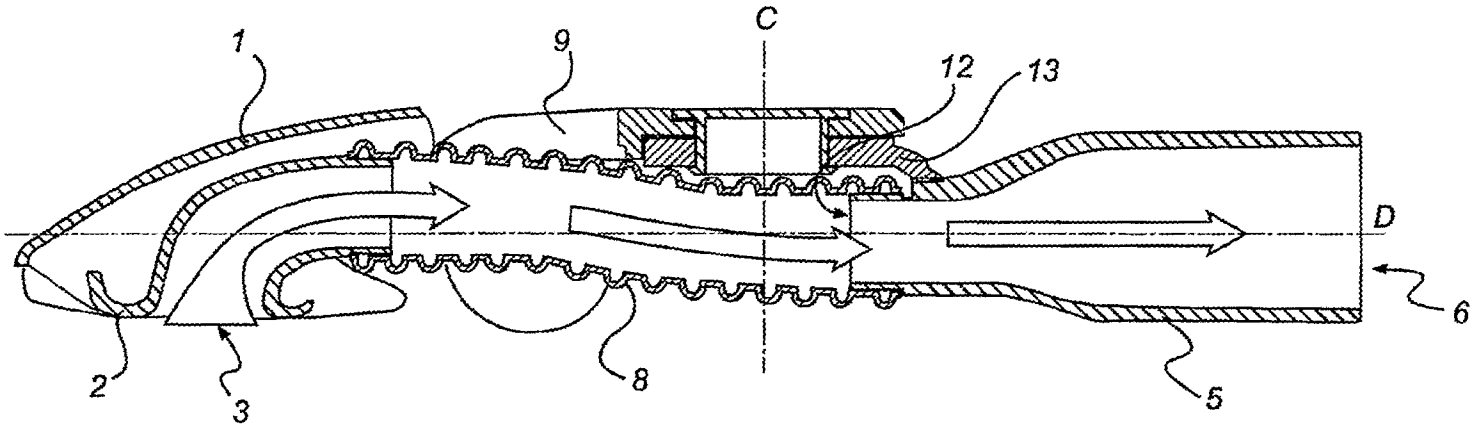
FIG. 5 is a cross-section side view of the vacuum cleaner nozzle of FIG. 1.

FIG. 5 shows a cross-section side view of the vacuum cleaner nozzle 100 along the axis D. For schematic reasons some structural feature are omitted from the cross-section, such as the housings 4*a* and 4*b*. The vacuum cleaner air stream or flow is guided through the suction inlet 3, through the flexible hose 8 and transformation conduit and out through the tubular opening 6.

The person skilled in the art realizes that the vacuum cleaner nozzle 1 by no means is limited to the embodiments described above. On the contrary, many modifications and variations are possible within the scope of the appended claims. Actually, almost any mentioned component of the vacuum cleaner nozzle 1 may have a different geometric shape. For example, the opening 6 of the nozzle outlet device 5 may conserve the rectangular cross-section shape to mate with a component having a rectangular cross-section. Additionally, the vacuum cleaner nozzle may also be provided with brush means surrounding the suction inlet 3.

The invention claimed is:

1. A vacuum cleaner nozzle comprising:

a nozzle body;

a suction plate having an elongated suction inlet, the suction plate being pivotally connected to the nozzle body about a first pivot axis that extends parallel to an elongated direction of the suction inlet;

a nozzle outlet device having, at an outlet end thereof, a tubular opening, which tubular opening is configured to be connectable to a tubular component of a vacuum cleaner;

and, a flexible hose interconnecting the elongated suction inlet with the nozzle outlet device such that the suction inlet is in fluid communication with the tubular opening of the nozzle outlet device;

wherein the nozzle outlet device is connected to the nozzle body by a link element comprising a forked first element and a second element, wherein the flexible hose extends within the forked first element and a first end of the forked first element is pivotally connected to the nozzle body on either side of the flexible hose about a second pivot axis that is parallel with the first pivot axis, and the second element is connected to a second end of the forked first element about a third pivot axis that is perpendicular to the first and second pivot axes and perpendicular to a longitudinal axis extending from the first end of the forked first element to the second end of the forked first element.

2. The vacuum cleaner nozzle according to claim 1, wherein the flexible hose has a generally oval or rectangular cross-section.

3. The vacuum cleaner nozzle according to claim 1, wherein the second end of the forked first element has a plate-like shape.

4. The vacuum cleaner nozzle according to claim 1, wherein the second element of the nozzle outlet device comprises, at an end proximal to the forked first element, a generally oval or rectangular opening connected to the flexible hose, and wherein the generally oval or rectangular opening is in fluid connection with the tubular opening at the outlet end by means of an transformation conduit.

5. The vacuum cleaner nozzle according to claim 4, wherein the transformation conduit is generally straight, whereby a generally straight flow path through the nozzle outlet device from the generally oval or rectangular opening to and through the tubular opening is achieved.

6. The vacuum cleaner nozzle according to claim 4, wherein the second end of the forked first element has a plate-like shape, and wherein the end of the second element that is proximal to the forked first element comprises a plate-like portion arranged to pivotally interact with the plate-like shape of the forked first element.

7. The vacuum cleaner nozzle according to claim 6, wherein the link element, the flexible hose and nozzle outlet device are arranged such that the thickness substantially corresponds to the outer diameter of the tubular opening.

8. The vacuum cleaner nozzle according to claim 1, wherein the suction plate is symmetrically arranged about the first pivot axis and wherein the elongated suction inlet is symmetrically arranged relative to the first pivot axis.

9. The vacuum cleaner nozzle according to claim 1, wherein the vacuum cleaner nozzle comprises glide means for keeping a desired distance between the suction inlet and a surface being cleaned, wherein the glide means is arranged within the suction inlet.

10. The vacuum cleaner nozzle according to claim 9, wherein the glide means is symmetrically arranged within the suction inlet relative the first pivot axis.

11. The vacuum cleaner nozzle according to claim 9 or 10, wherein the glide means is arranged such that when the elongated suction inlet is pivoted to a predetermined angle about the first pivot axis, the glide means is elevated above the surface being cleaned.

12. The vacuum cleaner nozzle according to claim 9, wherein the glide means comprises wheels that support the nozzle body.

13. The vacuum cleaner nozzle according to claim 1 or 9, wherein the vacuum cleaner nozzle comprises one or more of a brush and a rubber strip attached to the nozzle body and arranged at least partly around the elongated suction inlet.

* * * * *